US007354884B2

(12) United States Patent
Hada et al.

(10) Patent No.: US 7,354,884 B2
(45) Date of Patent: Apr. 8, 2008

(54) THERMAL RECORDING MATERIAL

(75) Inventors: Toshiro Hada, Amagasaki (JP); Shigeji Matsuzawa, Amagasaki (JP); Masanao Tajiri, Amagasaki (JP); Ritsuo Mando, Koto-ku (JP)

(73) Assignee: OJI Paper Co., Ltd., Tokyo (JP)

( * ) Notice: Subject to any disclaimer, the term of this patent is extended or adjusted under 35 U.S.C. 154(b) by 343 days.

(21) Appl. No.: 10/526,779

(22) PCT Filed: Sep. 8, 2003

(86) PCT No.: PCT/JP03/11403

§ 371 (c)(1),
(2), (4) Date: Mar. 8, 2005

(87) PCT Pub. No.: WO2004/024460

PCT Pub. Date: Mar. 25, 2004

(65) Prior Publication Data

US 2005/0239646 A1 Oct. 27, 2005

(30) Foreign Application Priority Data

Sep. 13, 2002 (JP) ..... 2002-267593
Oct. 21, 2002 (JP) ..... 2002-305559
Mar. 19, 2003 (JP) ..... 2003-075368

(51) Int. Cl.
*B41M 5/20* (2006.01)
*B41M 5/24* (2006.01)

(52) U.S. Cl. ..... 503/207; 503/200; 503/214; 503/226

(58) Field of Classification Search ..... 503/200, 503/207, 214, 226
See application file for complete search history.

(56) References Cited

U.S. PATENT DOCUMENTS

| | | | | |
|---|---|---|---|---|
| 5,409,881 | A | 4/1995 | Mori et al. | 503/207 |
| 5,514,636 | A * | 5/1996 | Takeuchi | 503/207 |
| 5,593,938 | A | 1/1997 | Takeuchi | 503/206 |
| 5,883,042 | A | 3/1999 | Defieuw et al. | 503/201 |
| 5,919,729 | A | 7/1999 | Mori et al. | 503/200 |

FOREIGN PATENT DOCUMENTS

| | | | |
|---|---|---|---|
| EP | 1 208 995 | A2 | 5/2002 |
| JP | 3-244586 | A | 10/1991 |
| JP | 5-8542 | A | 1/1993 |
| JP | 5-32042 | A | 2/1993 |
| JP | 6-32056 | A | 2/1994 |
| JP | 7-290822 | A | 11/1995 |
| JP | 7-314898 | A | 12/1995 |
| JP | 9-175019 | A | 7/1997 |
| JP | 9-193551 | A | 7/1997 |
| JP | 9-220857 | A | 8/1997 |
| JP | 9-226252 | A | 9/1997 |
| JP | 10-157299 | A | 6/1998 |
| JP | 10-193796 | A | 7/1998 |
| JP | 11-70735 | A | 3/1999 |
| JP | 11-115311 | A | 4/1999 |
| JP | 2000-6520 | A | 1/2000 |
| JP | 2000-355165 | A | 12/2000 |
| JP | 2002-67500 | A | 3/2002 |
| JP | 2002-301868 | A | 10/2002 |
| JP | 2002-326456 | A | 11/2002 |
| JP | 2002-331752 | A | 11/2002 |
| JP | 2002-331753 | A | 11/2002 |
| JP | 2003-127543 | A | 5/2003 |
| JP | 2003-266943 | A | 9/2003 |
| JP | 2003-276329 | A | 9/2003 |

* cited by examiner

*Primary Examiner*—Callie Shosho
*Assistant Examiner*—David J. Joy
(74) *Attorney, Agent, or Firm*—Kubovcik & Kubovcik

(57) ABSTRACT

Disclosed is a heat-sensitive recording material comprising (a) a transparent film, (b) a heat-sensitive recording layer formed on one side of the transparent film, and containing an electron-donating compound, an electron-accepting compound, and a binder, (c) a protective layer formed on the heat-sensitive recording layer, and containing an aqueous resin as a primary component; and (d) a backside layer formed on the other side of the transparent film, and containing a pigment and a binder; the heat-sensitive recording material containing in the backside layer spherical resin particles having a mean volume particle diameter of 2 to 15 μm in an amount of 0.2 to 5.0 mass % of the backside layer.

17 Claims, No Drawings

THERMAL RECORDING MATERIAL

This application is a 371 of international application PCT/JP2003/011403, which claims priority based on Japanese patent application Nos. 2002-267593, 2002-305559 and 2003-75368, filed Sep. 13, 2002, Oct. 21, 2002, and Mar. 19, 2003, respectively, which are incorporated herein by reference.

TECHNICAL FIELD

The present invention relates to a heat-sensitive recording material that takes advantage of a color forming reaction between an electron-donating compound and an electron-accepting compound.

BACKGROUND ART

Heat-sensitive recording materials that take advantage of a color forming reaction between an electron-donating compound and an electron-accepting compound are relatively inexpensive. Recording devices for such heat-sensitive recording materials are compact and their maintenance is easy. Therefore, such heat-sensitive recording materials have been used in a broad range of technical fields, for example, as recording media for facsimiles, word processors, computers, video cassette recorders, medical images and other applications.

Recently, there has been an increasing demand for the development of heat-sensitive recording materials having excellent transparency and image quality for use as substitute recording media for silver halide films for recoding medical images, typically radiographs for medical images. However, heat-sensitive recording materials, in which a heat-sensitive recording layer has been formed on a transparent film to enhance transparency and image quality, suffer blocking, when exposed to high humidities, due to adhesion of the front side and backside thereof, particularly when they are used in the form of a roll.

Such a heat-sensitive recording material in which a heat-sensitive recording layer is formed on a transparent film is disclosed in Japanese patent No. 2761985, in which a heat-sensitive recording material comprises a heat-sensitive recording layer on one side of the transparent film, and an antireflective layer containing a binder and a pigment with a particle diameter of 7.5 to 50 μm on the other side. The object of this patent is to enhance the image quality by providing such antireflective layer to thereby reduce glitter that occurs when the heat-sensitive recording material is viewed through its support, and the patent does not disclose the problem of preventing blocking or a means for solving the problem.

Also known is a heat-sensitive recording material which comprises, on one side of a transparent film, a heat-sensitive recording layer and a protective layer mainly containing a resin and a filler and formed on the heat-sensitive recording layer, and, on the other side of the transparent film, an antistatic layer containing a binder, fine spherical resin particles having a particle diameter of about 1 to about 6 μm and an antistatic agent (Japanese Unexamined Patent Publication No. 1998-193796). This patent publication describes that, due to the use of the fine spherical resin particles and the antistatic agent such as a conductive metal oxide in the antistatic layer, this heat-sensitive recording material allows smooth feeding within recording devices, forms dimensionally accurate images, prevents dust accumulation, and prevents blocking. However, such heat-sensitive recording material, when exposed to high humidities, sometimes suffers blocking because of adhesion of the front side and backside.

DISCLOSURE OF THE INVENTION

An object of the present invention is to provide a heat-sensitive recording material that does not undergo blocking caused by adhesion of the front side and backside thereof even when exposed to highly humid conditions, for example, 40° C. and 90% RH.

In a heat-sensitive recording material which comprises, on one side of a transparent film (hereinafter referred to as the "front side"), a heat-sensitive recording layer containing an electron-donating compound, an electron-accepting compound and a binder, and a protective layer containing a water soluble resin and/or water dispersible resin (hereinafter collectively referred to as "aqueous resins"), and on the other side of the transparent film (hereinafter referred to as the "backside") a backside layer containing a pigment and a binder, the present invention is characterized in that as a means for solving the problem described above, spherical resin particles having a mean volume particle diameter of 2 to 15 μm are contained as the pigment in the backside layer in a proportion of 0.2 to 5.0 mass % of the backside layer.

In particular, the present invention provides the following heatsensitive recording materials:

Item 1. A heat-sensitive recording material comprising:

(a) a transparent film;

(b) a heat-sensitive recording layer formed on one side of the transparent film, and containing an electron-donating compound, an electron-accepting compound, and a binder;

(c) a protective layer formed on the heat-sensitive recording layer, and containing an aqueous resin as a main ingredient; and (d) a backside layer formed on the other side of the transparent film, and containing a pigment and a binder, the heat-sensitive recording material containing, as the pigment, in the backside layer spherical resin particles having a mean volume particle diameter of 2 to 15 μm in an amount of 0.2 to 5.0 mass % of the backside layer.

Item 2. A heat-sensitive recording material according to Item 1, wherein the average thickness of the backside layer is 0.5 to 10 μm and is less than the mean volume particle diameter of the spherical resin particles contained in the backside layer.

Item 3. A heat-sensitive recording material according to Item 1, wherein the binder in the backside layer has a glass transition temperature of 180 to 250° C.

Item 4. A heat-sensitive recording material according to Item 1, wherein the binder in the backside layer is a (meth) acrylamide-based resin binder having a glass transition temperature of 180 to 250° C.

Item 5. A heat-sensitive recording material according to Item 4, wherein the binder in the backside layer further contains an ionomeric urethane-based resin.

Item 6. A heat-sensitive recording material according to Item 1, wherein the aqueous resin in the protective layer is an acetoacetyl-modified polyvinyl alcohol having a polymerization degree of 1500 to 3000 and a saponification degree of at least 95 mol %.

Item 7. A heat-sensitive recording material according to Item 6, wherein the protective layer further contains an ionomeric urethane-based resin as another aqueous resin.

Item 8. A heat-sensitive recording material according to Item 7, wherein the ionomeric urethane-based resin is present in an amount of 10 to 60 mass % relative to the acetoacetyl-modified polyvinyl alcohol.

Item 9. A heat-sensitive recording material according to Item 1, wherein the protective layer further contains a fluorine-containing surfactant and at least one compound selected from the group consisting of alkylphosphate salts, waxes and higher fatty acid amides.

Item 10. A heat-sensitive recording material according to Item 9, wherein the total amount of said fluorine-containing surfactant and said at least one compound selected from the group consisting of alkyl phosphate salts, waxes and higher fatty acid amides is 0.5 to 15 mass % of the protective layer.

Item 11. A heat-sensitive recording material according to Item 9, wherein said at least one compound selected from the group consisting of alkyl phosphate salts, waxes and higher fatty acid amides is present in a proportion of 50 to 800 mass % relative to the fluorine-containing surfactant.

Item 12. A heat-sensitive recording material according to Item 1, wherein the protective layer contains an alkyl phosphate salt, a fluorine-containing surfactant, and a compound selected from the group consisting of waxes and higher fatty acid amides.

Item 13. A heat-sensitive recording material according to Item 1, wherein the protective layer contains an alkyl phosphate salt, a higher fatty acid amide and a fluorine-containing surfactant.

Item 14. A heat-sensitive recording material according to Item 1, wherein the binder in the heat-sensitive recording layer contains an ionomeric urethane-based resin and a styrene-butadiene-based resin.

Item 15. A heat-sensitive recording material according to Item 14, wherein the styrene-butadiene-based resin is present in a proportion of 100 to 300 mass parts per 100 mass parts of the ionomeric urethane-based resin.

Item 16. A heat-sensitive recording material according to Item 1, wherein the electron-donating compound in the heat-sensitive recording layer is a leuco dye, and the leuco dye is microencapsulated in a resin film or is in the form of resin composite particles containing the leuco dye.

Item 17. A heat-sensitive recording material according to Item 14, wherein the heat-sensitive recording layer has a thickness of 15 to 30 μm.

Item 18. A heat-sensitive recording material according to Item 1, wherein the transparent film is a polyethylene terephthalate film having a thickness of 40 to 250 μm.

Item 19. A heat-sensitive recording material according to Item 1 having a haze value of 10 to 50%.

DETAILED DESCRIPTION OF THE INVENTION

Transparent Film

Examples of the transparent film are unstretched or biaxially stretched polyethylene terephthalate films, polystyrene films, polypropylene films, polycarbonate films, etc. Although the thickness of such films can be suitably selected from a broad range, it is preferably about 40 to about 250 μm considering ease of application of the backside layer coating composition and the heat-sensitive recording layer coating composition.

Such transparent films may be colored, for example, blue, insofar as the haze value thereof is not higher than 10% to enhance their suitability for Schaukasten (a view box used when physicians look at X-ray photographs).

The haze value of heat-sensitive recording materials is preferably about 10 to about 50%, and particularly preferably about 10 to about 35%. The haze value of the heat-sensitive recording material can be controlled to be within the aforementioned ranges by suitably selecting the components of the backside layer, heat-sensitive recording layer, and protective layer; coating amounts of these layers and the like in light of the teaching of this specification.

Backside Layer

According to the present invention, a heat-sensitive recording layer and a protective layer are formed on one side (front side) of the transparent film, and a backside layer containing a pigment and a binder is formed on the other side (backside) of the transparent film, in which spherical resin particles having a mean volume particle diameter of 2 to 15 μm are contained as the pigment in a proportion of preferably 0.2 to 5.0 mass %, more preferably about 0.3 to 3.5 mass %, of the backside layer, thereby producing a heat-sensitive recording material that does not undergo blocking caused by adhesion of the front side and backside even when exposed to conditions of 40° C. and 90% RH.

<Pigments for Backside Layer>

When the proportion of spherical resin particles having a mean volume particle diameter of 2 to 15 μm is less than 0.2 mass %, the effect of preventing blocking may be significantly impaired, allowing adhesion of the front side and backside. When the proportion exceeds 5.0 mass %, the haze value of the heat-sensitive recording material may become low.

Moreover, when spherical resin particles having a mean volume particle diameter of less than 2 μm are used, the effect of preventing blocking maybe significantly impaired. On the other hand, when spherical resin particles having a mean volume particle diameter more than 15 μm are used, the resin particles may easily separate from the backside layer, or the front side of the heat-sensitive recording material may be damaged. The more preferable mean volume particle diameter is about 3 to about 10 μm.

In this specification, the "mean volume particle diameter" of spherical resin particles is measured according to the Coulter counter method.

Absolutely spherical resin particles are preferably used in the backside layer. However, resin particles that are not absolutely spherical are also usable. Although the sphericity thereof is not limited, a sphericity of 0.7 or greater is preferable. Sphericity herein refers to the ratio of the minor axis (X) to the major axis (Y) of a resin particle (X/Y).

Spherical resin particles are preferably made of, for example, acryl-based resins, styrene-based resins, silicone-based resins, polycarbonate-based resins, etc. Among such examples, acryl-based resins and styrene-based resins are preferable due to their cost advantages. In particular, acryl-based resins, especially methyl methacrylate resins, are preferable due to their cost advantages and strength.

The aforementioned spherical resin particles are known and are readily available, and a variety of such resin particles are commercially available.

<Binders for Backside Layer>

Examples of binders usable in the backside layer are casein, polyvinyl alcohol-based resins, diisobutylene-maleic anhydride-based resins, styrene-maleic anhydride-based resins, acryl-based resins (e.g., acrylic acid-acrylic acid ester copolymer latexes and the like), (meth)acrylamide-based resins, vinyl acetate-based resins, urethane-based resins, etc.

In the description and claims, the term "(meth)acrylamide" is intended to mean at least one member selected from the group consisting of methacrylamide and acrylamide.

The glass transition temperature (Tg) of such binders is not limited and maybe suitably selected from a broad range. Generally, however, the glass transition temperature is 180 to 250° C., more preferably 200 to 230° C.

In particular, the use of a (meth)acrylamide-based resin binder having a glass transition temperature of 180 to 250° C., particularly 200 to 230° C., produces the effect of inhibiting curling inward in the direction of the recording layer in a low-humidity environment both before and after recording. Among such (meth)acrylamide-based resins, preferable are core-shell-structured latexes in which, for example, the shell is made of a (meth)acrylamide-based resin and the core is made of an acrylic acid ester-based resin (weight ratio of core:shell=1:1 to 5). Such core-shell-structured latexes are known, and are disclosed in, for example, Japanese Unexamined Patent Publication No. 1993-69665, and are also commercially available.

The resin constituting the shell of the resin particles having the aforementioned core/shell structure is produced by seed-polymerizing at least one monomer in the presence of an aqueous dispersion of seed particles. As the resin of the shell, a resin prepared by seed-polymerizing at least one member selected from the group consisting of methacrylamide and acrylamide is particularly preferable.

Such a resin can be obtained according to known methods, for example, a method disclosed in Japanese Unexamined Patent Publication No. 1993-69665, by emulsion-polymerizing at least one member selected from the group consisting of methacrylamide and acrylamide using, as cores, hydrophobic particles (seed particles) produced by polymerizing one or more unsaturated monomers.

If necessary, in the seed-polymerization, (meth)acrylamide may be conjointly used with one or more other unsaturated monomers copolymerizable with (meth)acrylamide. Examples of such other unsaturated monomers are methyl(meth)acrylate, ethyl(meth)acrylate, butyl(meth) acrylate, 2-ethylhexyl (meth)acrylate, 2-hydroxyethyl (meth)acrylate, 2-hydroxypropyl (meth)acrylate, 2-aminoethyl(meth)acrylate, glycidyl (meth)acrylate, (meth)acrylic acid, maleic anhydride, itaconic acid, fumaric acid, crotonic acid, (meth)acrylonitrile, styrene, α-methylstyrene, divinylbenzene, etc.

The proportion of (meth)acrylamide contained in the seed-polymerized resin(s) constituting the shell is 50 to 100 mass %, and preferably 70 to 100 mass %, of the seed-polymerized resin(s) constituting the shell.

Examples of seed particles include various known latex particles of acrylic acid ester-based latexes such as methyl (meth)acrylate, ethyl(meth)acrylate or butyl(meth)acrylate; styrene-butadiene-based latexes; styrene-acrylate-based latexes; etc. Copolymerized (meth)acrylamide may be present in the seed particles.

In the present invention, when a core/shell-structured resin as described above is used, the glass transition temperature of the binder used in the backside layer refers to the glass transition temperature of the resin constituting the shell.

The proportion of the binder having a glass transition temperature of 180 to 250° C. is preferably about 30 to about 99.8 mass %, and particularly preferably about 50 to about 80 mass %, of the total solids content of the backside layer.

If necessary, adhesion of the backside layer to the transparent film support may be enhanced by using a urethane-based resin binder, particularly an ionomeric urethane-based resin, in the backside layer in a proportion of about 3 to about 30 mass %, particularly about 5 to about 20 mass %, of all the binders.

Such ionomeric urethane-based resins to be used include, for example, those disclosed in Japanese Unexamined Patent Publication No. 1993-8542 (paragraphs 0017 to 0019 in particular). Unlike conventional emulsion-type resins in which a polyurethane resin is dispersed in water with the use of an emulsifier or the like, such ionomeric urethane-based resins are aqueous urethane resins in which a polyurethane resin having ionic nature, namely ionomeric urethane-based resin, due to its ionic groups, is dissolved or colloidally dispersed in the form of very fine particles in water without the use of an emulsifier or an organic solvent. Typical examples of ionomeric urethane-based resins are resins of Hydran HW series and Hydran AP series manufactured by DAINIPPON INK AND CHEMICALS INC., resins of Superflex series manufactured by DAI-ICHI KOGYO SEIYAKU CO., LTD., and the like.

It is preferable that the proportion of the binder in the backside layer is about 80 to about 99.8 mass %, particularly about 90 to about 99.5 mass %, of the total solids of the backside layer.

<Method for Forming Backside Layer and Other Particulars>

The backside layer can be formed by preparing a backside layer coating composition, using water as a medium, by stirring and mixing spherical resin particles having a mean volume particle diameter of 2 to 15 μm, a binder and, if desired additives that can be contained in the heat-sensitive recording layer described below, applying the backside layer coating composition to the backside of a transparent film, and drying the resulting layer.

Although the thickness of the backside layer is not limited, the average thickness of the backside layer is preferably about 0.5 to about 10 μm, and more preferably about 2 to about 6 μm. The backside layer having an average thickness less than the mean volume particle diameter of the spherical resin particles contained in the backside layer produces the effect of reducing the frictional resistance between the front side and the backside of a heat-sensitive recording material, thereby inhibiting multi-feeding problem in printers for sheet-form heat-sensitive recording materials (i.e., the problem that two or more sheets of a sheet-form heat-sensitive recording material are simultaneously fed). The average thickness of the backside layer herein refers to that measured by electron microscope.

Although the backside layer coating composition is usually applied in an amount of 0.1 to 15 g/m$^2$, and in particular 0.5 to 10 g/m$^2$, on dry weight basis, it is preferable to apply the composition in an amount such that the average thickness of the backside layer is 0.5 to 10 μm from the standpoint of inhibiting multi-feeding problem as described above.

Due to the provision of the specific backside layer, the heat-sensitive recording material of the present invention exhibits excellent blocking resistance and pre- and post-recording curl resistances. To further enhance post-recording curl resistance, the heat-sensitive recording material can be subjected to a reverse curl treatment. The reverse curl treatment is intended to mean a treatment comprising winding, after the formation of the respective layers, the resulting heat-sensitive recording material with the protective layer facing outward, and curing the heat-sensitive recording material in this position, thereby giving a curl to the backside. If it is desired to precisely control the extent of the reverse curling, the heat-sensitive recording material that has been cut in the form of a sheet may be subjected to a curing treatment while it is kept reverse-curled using a curled metal plate or the like. Although curing treatment can be carried out under a variety of conditions, the heat-sensitive recording material is preferably cured by allowing it to stand at, for example, 30 to 50° C. and 20 to 80% RH for 1 to 5 days.

Heat-Sensitive Recording Layer

For the thermal recording method taking advantage of a combination of an electron-donating compound and an electron-accepting compound contained in the heat-sensitive recording layer, examples of such a combination are a combination of a leuco dye and a developer, a combination of a diazonium salt and a coupler, a combination of an organic silver salt and a reducing agent, a combination of a transition element such as iron, cobalt, copper or the like with a chelating compound, a combination of an aromatic isocyanate compound and an imino compound, and the like. The combination of a leuco dye and a developer is preferably used because it gives excellent color density. Hereinbelow, a heat-sensitive recording material employing a combination of a leuco dye and a developer will be described in detail.

<Leuco Dyes and Developers>

A wide variety of known leuco dyes and developers are usable. Specific examples of leuco dyes are 3-[2,2-bis(1-ethyl-2-methylindol-3-yl)vinyl]-3-(4-diethylamino-phenyl)phthalide, 3,3-bis(p-dimethylaminophenyl)-6-dimethylaminophthalide, 3-(4-diethylamino-2-methylphenyl)-3-(4-diethylaminophenyl)-6-dimethylaminophthalide, 3-cyclohexylamino-6-chlorofluoran, 3-diethylamino-6-methyl-7-chlorofluoran, 3-diethylamino-6,8-dimethylfluoran, 3-diethylamino-7-chlorofluoran, 3-(N-ethyl-N-isoamyl)amino-6-methyl-7-anilinofluoran, 3-di(n-butyl)amino-6-methyl-7-anilinofluoran, 3-di(n-pentyl)amino-6-methyl-7-anilinofluoran, 3-(N-ethyl-p-toluidino)-6-methyl-7-anilinofluoran, 3-di(n-butyl)amino-6-chloro-7-anilinofluoran, 3-pyrrolidino-6-methyl-7-anilinofluoran, 3-piperidino-6-methyl-7-anilinofluoran, 3,3-bis[1-(4-methoxyphenyl)-1-(4-dimethylaminophenyl)ethylen-2-yl]-4,5,6,7-tetrachlorophthalide, 3-p-(p-dimethylaminoanilino)anilino-6-methyl-3-p-(p-chloroanilino)anilino-6-methyl-7-chlorofluoran, 3-[1,1-bis(1-ethyl-2-methylindol-3-yl)]-3-p-diethylaminophenyl-phthalide, 3,3-bis(1-n-butyl-2-methylindol-3-yl)phthalide, 3,6-bis(dimethylamino)fluorene-9-spiro-3'-(6'-dimethylamino)-phthalide, 3,3-bis(4-diethylamino-2-ethoxyphenyl)-4-azaphthalide, etc.

Leuco dyes are not limited to those given above. Leuco dyes are usable in combination of two or more species. Although the amount of leuco dye cannot be specified because it varies depending on the developer to be used, it is preferably about 5 to about 35 mass %, and particularly preferably about 8 to about 25 mass %, of the total solids content of the heat-sensitive recording layer.

Examples of developers are 4,4'-isopropylidenediphenol, 4,4'-cyclohexylidenediphenol, 1,1-bis(4-hydroxyphenyl)ethane, 1,1-bis(4-hydroxyphenyl)-1-phenylethane, 4,4'-dihydroxydiphenylsulfone, 2,4'-dihydroxydiphenylsulfone, 4-hydroxy-4'-isopropoxydiphenylsulfone, 3,3'-diallyl-4,4'-dihydroxydiphenylsulfone, 2,2'-bis[4-(4-hydroxyphenyl)phenoxy]diethylether, 4,4'-bis[(4-methyl-3-phenoxycarbonylaminophenyl)ureide]diphenylsulfone, N-p-toluenesulfonyl-N'-3-(p-toluenesulfonyloxy)phenylurea, 3,3'-bis(p-toluenesulfonylaminocarbonylamino)diphenylsulfone, benzyl 4-hydroxybenzoate, N,N'-di-m-chlorophenylthiourea, N-p-tolylsulfonyl-N'-phenylurea, 4-4'-bis(p-tolylsulfonylaminocarbonylamino)diphenylmethane, zinc 4-[2-(p-methoxyphenoxy)ethyloxy]salicylate, zinc 4-[3-(p-tolylsulfonyl)propyloxy]salicylate, zinc 5-[p-(2-p-methoxyphenoxyethoxy)cumyl]salicylate, etc.

The ratio of the developer to the leuco dye may be suitably selected according to the type of the leuco dye and the developer and is not particularly limited. Generally, however, the developer is used in an amount of about 1 to about 10 mass parts, preferably about 2 to about 6 mass parts, per mass part of the leuco dye.

The use of a leuco dye microencapsulated in a resin film or in the form of resin composite particles containing the dye gives a heat-sensitive recording materials having a low haze value, and is therefore preferable. The mean volume particle diameter of such microcapsules and composite particles is preferably about 0.5 to about 3.0 μm, and particularly preferably about 0.5 to about 2.0 μm. Microencapsulated leuco dyes are known, and are disclosed in, for example, U.S. Pat. No. 4,682,194. Composite particles in which a leuco dye is contained in a resin are also known, and are disclosed in, for example, U.S. Pat. No. 5,804,528. The disclosures of these U.S. patents are incorporated herein by reference.

Particularly preferable composite particles are those comprising a leuco dye and a polyurea or polyurea-polyurethane resin. Preferable such composite particles are described below.

Composite particles comprising a leuco dye and a polyurea or polyurea-polyurethane resin is obtained by, for example, emulsifying and dispersing an oily solution containing a polyisocyanate compound and a leuco dye as dissolved therein, in a solution of a hydrophilic protective colloid such as polyvinyl alcohol to a mean particle diameter of about 0.5 to about 3 μm, and effecting the polymerization reaction of the polyisocyanate compound. The amount of the leuco dye contained in the composite particles is about 5 to about 70 mass %, and preferably about 30 to about 60 mass %, of the composite particles.

The specific leuco dye contained in the composite particles gives the effect of enhancing the transparency of the heat-sensitive recording layer compared with the use of the specific leuco dye alone in the form of a particle, presumably because the specific leuco dye in the composite particles is highly isolated from outside, so that background fogging and the disappearance of developed images due to heat or humidity therefore substantially do not occur, and the specific leuco dye is uniformly mixed with the resin component of the composite particles.

The polyisocyanate compound reacts with water to form an amine compound. This amine compound reacts with a polyisocyanate compound to form polyurea. These reactions and a reaction between an organic compound having a hydroxyl group and a polyisocyanate compound give polyurea-polyurethane.

The polyisocyanate compound may be used singly, or in the form of a mixture with at least one member selected from the group consisting of polyols and polyamines that can react with the polyisocyanate compound, or in the form of a polyisocyanate-polyol adduct or a multimer such as a biuret or an isocyanurate.

The specific leuco dye is dissolved in such a polyisocyanate compound. The solution is emulsified and dispersed in an aqueous medium containing a protective colloid substance such as polyvinyl alcohol as dissolved therein, and if necessary a reactive substance such as a polyamine is added thereto. The resulting emulsion or dispersion is then heated to polymerize the polymer-forming ingredients, thereby forming composite particles comprising the specific leuco dye and the resulting polymeric substance.

Examples of the polyisocyanate compound are p-phenylene diisocyanate, 1,3-bis(1-isocyanato-1-methylethyl) benzene, 2,6-tolylene diisocyanate, 2,4-tolylene diisocyanate, naphthalene-1,4-diisocyanate, dicyclohexylmethane-4,4'-diisocyanate, 1,3-bis(isocyanatomethyl)cyclohexane, 3,3'-dimethyldiphenylmethane-4,4'-diisocyanate, xylylene-1,4-diisocyanate, 4,4'-diphenylpropane diisocyanate, hexamethylene diisocyanate, butylene-1,2-diisocyanate, cyclohexylene-1,2-diisocyanate, cyclohexylene-1,4-diisocyanate, 4,4',4"-triphenylmethane triisocyanate, toluene-2,4,6-triisocyanate, trimethylolpropane adduct of hexamethylene diisocyanate, trimethylolpropane adduct of 2,4-tolylene diisocyanate, trimethylolpropane adduct of xylylene diisocyanate, etc.

Examples of polyol compounds are ethylene glycol, 1,3-propanediol, 1,4-butanediol, 1,7-heptanediol, 1,3-octanediol, propylene glycol, 1,3-dihydroxybutane, 2,2-dimethyl-l, 3-propanediol, 2,5-hexanediol, 3-methyl-1,5-pentanediol, 1,4-cyclohexanedimethanol, dihydroxycyclohexane, diethylene glycol, phenylethylene glycol, pentaerythritol, 1,4-di(2-hydroxyethoxy)benzene, 1,3-di (2-hydroxyethoxy)benzene, p-xylylene glycol, m-xylylene glycol, 4,4'-isopropylidenediphenol, 4,4'-dihydroxydiphenylsulfone, etc.

Examples of the polyamine compound are ethylenediamine, trimethylenediamine, tetramethylenediamine, pentamethylenediamine, hexamethylenediamine, p-phenylenediamine, 2,5-dimethylpiperazine, triethylenetriamine, triethylenetetramine, diethylaminopropylamine, tetraethylenepentamine, pentaethylenehexamine, etc.

The above polyisocyanate compounds, polyamines, polyol adducts of polyisocyanates, polyol compounds, etc., are not limited to those given above, and can be used in a combination of two or more, if so desired.

<Print Stability-Improving Agents and Sensitizers>

The heat-sensitive recording layer may contain a print stability-improving agent to enhance the long-term stability of recorded portions and a sensitizer to optimize the recording sensitivity. Examples of such print stability-improving agents are hindered-phenol compounds such as 2,2'-ethylidenebis(4,6-di-tert-butylphenol), 4,4'-thiobis(2-methyl-6-tert-butylphenol), 1,3,5-tris-(4-tert-butyl-3-hydroxy-2,6-dimethylbenzyl)isocyanuric acid, 1,1,3-tris(2-methyl-4-hydroxy-5-tert-butylphenyl)butane, 1,1,3-tris (2-methyl-4-hydroxy-5-cyclohexylphenyl)butane, 2,2-bis (4-hydroxy-3,5-dimethylphenyl)propane, and the like; epoxy compounds such as 1,4-diglycidyloxybenzene, 4,4'-diglycidyloxydiphenylsulfone, 4-benzyloxy-4'-(2-methylglycidyloxy)diphenylsulfone, diglycidyl terephthalate, cresol novolac epoxy resins, phenol novolac epoxy resins, bisphenol A epoxy resins, and the like; N,N'-di-2-naphthyl-p-phenylenediamine; sodium salt or polyvalent metal salts of 2,2'-methylenebis(4,6-di-tert-butylphenyl)phosphate; bis(4-ethyleneiminocarbonylaminophenyl)methane; etc.

Examples of the sensitizer are stearamide, methylenebisstearamide, dibenzyl terephthalate, benzyl p-benzyloxybenzoate, 2-naphthyl benzyl ether, m-terphenyl, p-benzylbiphenyl, p-tolyl biphenyl ether, di(p-methoxyphenoxyethyl)ether, 1,2-di(3-methylphenoxy) ethane, 1,2-di(4-methylphenoxy)ethane, 1,2-di(4-methoxyphenoxy)ethane, 1,2-di(4-chlorophenoxy)ethane, 1,2-diphenoxyethane, 1-(4-methoxyphenoxy)-2-(3-methylphenoxy)ethane, p-methylthiophenyl benzyl ether, 1,4-di (phenylthio)butane, p-acetotoluidide, p-acetophenetidide, N-acetoacetyl-p-toluidine, di(β-biphenylethoxy)benzene, oxalic acid di-p-chlorobenzyl ester, oxalic acid di-p-methylbenzyl ester, oxalic acid dibenzyl ester, etc.

Although the proportion of the print stability-improving agent is not limited, it is usually used in an amount of about 0.01 to about 4 mass parts per mass part of the developer. Although the amount of sensitizer is not limited, it is usually used in an amount of about 0.01 to about 4 mass parts per mass part of the developer.

<Binders for Heat-Sensitive Recording Layer>

Examples of binders usable for forming the heat-sensitive recording layer include, for example, water-soluble binders such as starches, hydroxyethylcellulose, methylcellulose, carboxymethylcellulose, casein, polyvinyl alcohol, carboxyl modified polyvinyl alcohol, diacetoneacrylamide-modified polyvinyl alcohol, acetoacetyl-modified polyvinyl alcohol, silicon-modified polyvinyl alcohol, diisobutylene-maleic anhydride copolymers, styrene-maleic anhydride copolymers, ethylene-acrylic acid copolymers, styrene-acrylic acid copolymers, and the like; water-dispersible binders such as vinyl acetate-based resins, styrene-butadiene-based resins, acryl-based resins, urethane-based resins, and the like.

Among them, the use of a urethane-based resin in combination with a styrene-butadiene-based resin is preferable. In particular, the use of an ionomeric urethane-based resin in combination with a styrene-butadiene-based resin affords the effect of preventing blurring of recorded image edges even when the recording energy is increased during thermal head recording.

Usually, recorded image edges are likely to be blurred by increased recording energy when a transparent film is used as the support and the thickness of the heat-sensitive recording layer exceeds 10 μm. However, the use of an ionomeric urethane-based resin in combination with a styrene-butadiene-based resin produces the effect of preventing recorded image edges from blurring and imparting excellent gradation of recorded images even when the heat-sensitive recording layer has a thickness of 15 to 30 μm.

Examples of such ionomeric urethane-based resins are those that can be used in the aforementioned backside layer as a binder.

Although the proportion of ionomeric urethane-based resin to styrene-butadiene-based resin is not limited, preferably the styrene-butadiene-based resin is used in an amount of about 100 to about 300 mass parts, and particularly about 100 to about 200 mass parts, per 100 mass parts of the ionomeric urethane-based resin.

The amount of the binder, in particular the total amount of the ionomeric urethane-based resin and the styrene-butadiene-based resin, in the heat-sensitive recording layer is about 10 to about 40 mass %, and preferably about 15 to about 35 mass %, of the heat-sensitive recording layer.

Ionomeric urethane-based resins and styrene-butadiene-based resins are each used in the form of a latex.

<Additives>

A variety of additives may be used in the heat-sensitive recording layer. Examples of such additives are pigments such as amorphous silica, calcium carbonate, zinc oxide, aluminum oxide, titanium dioxide, aluminum hydroxide, barium sulfate, talc, kaolin, clay, calcined kaolin or urea-formaldehyde resin fillers, in which the primary particles thereof have a mean particle diameter of about 0.01 to about 2.0 μm; surfactants such as sodium dioctylsulfosuccinate, sodium dodecylbenzenesulfosuccinate, sodium lauryl sulfate, fatty acid metal salts and the like; lubricants; antifoaming agents; thickeners; pH-adjusters; ultraviolet absorbers; light stabilizers; crosslinking agents; fluorescent dyes; coloring dyes; etc. Additives are not limited to those given above, and they can be used in a combination of two or more.

<Method for Forming Heat-Sensitive Recording Layer>

The heat-sensitive recording layer can be formed by, for example, concurrently or separately pulverizing a leuco dye, a developer, and if desired, a sensitizer, a print stability-improving agent and the like by means of a ball mill, attritor, sand mill or like mixing/pulverizing apparatus to a mean particle diameter of 3 μm or less, and preferably 2 μm or less; adding at least a binder thereto to prepare a heat-sensitive recording layer coating composition; applying the coating composition to the front side of the transparent film in an amount such that the thickness thereof after drying is, for example, about 3 to about 35 μm, and preferably about 15 to about 30 μm; and drying the coating composition. It is usually sufficient that the heat-sensitive recording layer coating composition is applied to the front side of the transparent film in an amount such that the amount thereof after drying is about 3 to about 35 g/m$^2$, and preferably about 15 to about 30 g/m$^2$, and the resulting coating is then dried.

Protective Layer

A protective layer that mainly contains an aqueous film-forming resin is provided on the heat-sensitive recording layer to enhance runnability during recording, friction-fogging resistance, chemical resistance, and resistance to blocking with the backside layer of the heat-sensitive recording material. This produces the effect of increasing the transparency of the heat-sensitive recording material.

Examples of such an aqueous resin in the protective layer are, for example, said at least one member selected from the group consisting of water-soluble resins and water-dispersible resins that are usable as binders in the aforementioned heat-sensitive recording layer.

Although the amount of said at least one member selected from the group consisting of water-soluble resins and water-dispersible resins can be selected from a broad range, it is usually about 40 to about 95 mass %, and preferably about 50 to about 80 mass %, of the protective layer.

Among such aqueous resins, acetoacetyl-modified polyvinyl alcohol having a polymerization degree of 1500 to 3000 and a saponification degree of 95 mol % or greater (hereinafter referred to as "specific acetoacetyl-modified polyvinyl alcohol") is preferable to increase resistance to blocking with the backside layer.

When the polymerization degree of the acetoacetyl-modified polyvinyl alcohol is less than 1500, thermal head recording at an increased recording energy is likely to give rough-surfaced recorded portion, thereby impairing suitability for Schaukasten. When the polymerization degree exceeds 3000, the concentration of the protective layer coating composition has to be lowered in order to adjust the viscosity of the protective layer coating composition to be in the applicable range for forming the protective layer, and therefore the resulting protective layer coating composition is likely to become less easy to apply and fail to produce a uniform protective layer surface.

A particularly preferable polymerization degree of the specific acetoacetyl-modified polyvinyl alcohol is about 2100 to about 2500.

When the saponification degree of acetoacetyl-modified polyvinyl alcohol is less than 95 mol %, the protective layer is likely to stick to the thermal head during recording to impair the recorded image quality.

Moreover, when the saponification degree of the specific polyvinyl alcohol is less than 95 mol %, and if an ionomeric urethane-based resin is also used as an aqueous resin to enhance the water resistance of the protective layer, the surface of the protective layer becomes cloudy and the transparency of the heat-sensitive recording material is thereby lowered, presumably due to the low compatibility between the specific polyvinyl alcohol and the ionomeric urethane-based resin, resulting in impaired Schaukasten suitability.

It is preferable that the specific polyvinyl alcohol has an acetoacetyl modification degree of preferably about 0.5 to about 10 mol %. An acetoacetyl modification degree of less than 0.5 mol % is likely to impair water resistance. An acetoacetyl modification degree exceeding 10 mol % is likely to impair not only the water solubility of the acetoacetyl-modified polyvinyl alcohol itself but also the water resistance of the protective layer.

If desired, in addition to the aforementioned specific polyvinyl alcohol, an ionomeric urethane-based resin may be used as an aqueous resin in the protective layer, thereby affording the effect of increasing sticking resistance during recording and increasing water resistance of the protective layer. Examples of such ionomeric urethane resins are those that are usable in the aforementioned backside layer as a binder.

The ionomeric urethane-based resin in the protective layer is preferably used in an amount of about 10 to about 60 mass %, more preferably about 20 to about 50 mass %, relative to the specific acetoacetyl-modified polyvinyl alcohol. When the amount of the ionomeric urethane-based resin is less than 10 mass % relative to the specific acetoacetyl modified polyvinyl alcohol, the effect of enhancing water resistance may be insufficient. When the amount exceeds 60 mass %, the chemical resistance of recorded portions may be impaired.

Addition, to the heat-sensitive recording layer, of a crosslinking agent that crosslinks to the specific acetoacetyl-modified polyvinyl alcohol in the protective layer, enhances the film forming ability of the protective layer to be formed on the heat-sensitive recording layer, adhesion between the protective layer and the heat-sensitive recording layer, and water resistance of the protective layer. Examples of such crosslinking agents are glyoxal, adipic dihydrazide, dimethylolurea, dialdehyde starches, melamine resins, polyamidoamine-epichlorohydrin resins, borax, boric acid, ammonium zirconium carbonate, etc. The amount of crosslinking agent is preferably about 1 to about 20 mass parts, and particularly about 2 to about 15 mass parts, per 100 mass parts of the specific acetoacetyl modified polyvinyl alcohol in the protective layer.

The protective layer may further contain, for example, pigments such as calcium carbonate, zinc oxide, aluminum oxide, titanium dioxide, amorphous silica, aluminum hydroxide, barium sulfate, talc, kaolin, styrene resin fillers, nylon resin fillers, urea-formaldehyde resin fillers and the like; lubricants such as zinc stearate, calcium stearate and the like; waxes such as paraffin, polyethylene wax, polypropylene wax, carnauba wax and the like; surfactants such as perfluoroalkyl carboxylic acid salts, perfluoroalkyl phosphate salts, perfluoroalkyl sulfonate salts, ethylene oxide adducts of perfluoroalkyl amide, dialkyl sulfosuccinate salts, alkylsulfonic acid salts, alkyl carboxylic acid salts, alkyl phosphate salts, alkyl ethylene oxides, and the like; and auxiliaries such as higher fatty acid amide including stearamide, methylenebisstearamide, ethylenebisstearamide and the like.

Particularly, the use of a fluorine-containing surfactant in combination with at least one member selected from alkyl phosphate salts, waxes and higher fatty acid amides affords excellent sticking resistance and the effect of preventing the impairment of recorded image quality caused by the residual substance accumulation on thermal heads.

In particular, it is preferable to use a fluorine-containing surfactant and an alkyl phosphate in combination with a wax or a higher fatty acid amide. Especially, combined use of a fluorine-containing surfactant, an alkyl phosphate salt and a higher fatty acid amide is preferable.

With respect to the proportion of a fluorine-containing surfactant to said at least one member selected from alkyl phosphate salts, waxes and higher fatty acid amides, it is preferable to use said at least one member selected from alkyl phosphate salts, waxes and higher fatty acid amides in an amount of 50 to 800 mass %, and particularly preferably 100 to 500 mass %, relative to the fluorine-containing surfactant.

When a fluorine-containing surfactant and an alkyl phosphate salt are used in combination with a wax or a higher fatty acid amide, it is preferable to use the alkyl phosphate salt in an amount of about 10 to about 100 mass %, and to use the wax or higher fatty acid amide in an amount of about 50 to about 600 mass %, relative to the fluorine-containing surfactant.

The total amount of the fluorine-containing surfactant and said at least one member selected from the group consisting of alkyl phosphate salts, waxes and higher fatty acid amides is preferably 0.5 to 15 mass %, and particularly 3 to 12 mass %, of the protective layer.

Preferable fluorine-containing surfactants are anionic or nonionic ones, and include, for example, perfluoroalkyl carboxylic acid salts, perfluoroalkyl phosphate salts, perfluoroalkylsulfonic acid salts, ethylene oxide adducts of perfluoroalkyl amide, etc. Alkyl groups in such compounds preferably have about 6 to about 30 carbon atoms. Lithium, potassium and ammonium salts are preferable among such salts. Nonionic ethylene oxide adducts of perfluoroalkyl amide (especially, those in which the number of moles of ethylene oxide added is about 5 to about 20) are particularly preferable.

Preferable alkyl phosphate salts are, for example, salts of monoalkyl phosphates and salts of dialkyl phosphates, the alkyl having about 8 to about 24 carbon atoms. Lithium, potassium, and ammonium salts are preferable among such salts. Potassium salts of monoalkyl phosphates are particularly preferable.

Examples of waxes include paraffin wax, polyethylene wax, polypropylene wax, and the like having a melting point of about 50 to about 120° C. Among them, polyethylene wax is preferable.

Examples of higher fatty acid amides include $C_{16-24}$ higher fatty acid amide, such as stearamide, behenamide, ethylenebisstearamide, etc. Among them, stearamide is preferable.

The mean volume particle diameter of such waxes and higher fatty acid amides is not particularly limited. Generally, however, it is preferably about 0.1 to about 3.0 μm, and more preferably about 0.1 to about 2.0 μm.

The protective layer can be formed, typically using water as a medium, by preparing a protective layer coating composition by stirring and mixing the aqueous resin and, if desired, pigments, crosslinking agents, waxes, higher fatty acid amide, surfactants, etc.; applying the protective layer coating composition to the heat-sensitive recording layer in an amount such that the amount thereof after drying is about 0.5 to about 10 g/m$^2$, and preferably about 1 to about 5 g/m$^2$; and drying the coating.

Coating compositions for respective layers can be applied according to any of known coating methods such as a slot-die method, slide bead method, curtain method, air knife method, blade method, gravure method, roll coater method, spray method, dip method, bar method, extrusion method, and the like.

After forming all the layers, performing a smoothing treatment according to a known smoothing method such as supercalendering, softcalendering, etc., is effective for improving recording sensitivity. The heat-sensitive recording layer and the protective layer may be treated by being pressed against either the metal roll or the elastic roll of such calendar.

BEST MODE FOR CARRYING OUT THE INVENTION

The present invention will be illustrated in further detail with reference to Examples below. It should be understood that the scope of the invention is not limited by these Examples. Herein, "parts" and "%" represent "mass parts" and "mass %", respectively, unless otherwise specified. With respect to the spherical resin particles used for the backside layer, the "mean volume particle diameter" thereof was measured according to the Coulter counter method, and the mean volume particle diameter of particles for other purposes is measured according to the laser diffraction method, unless otherwise specified.

EXAMPLE 1

Preparation of Backside Layer Coating Composition

A composition containing 425 parts of a core-shell latex in which the shell is made of an acrylamide-based resin (glass transition temperature: 218° C.) and the core is made of an acrylic acid ester resin (glass transition temperature: 10° C.) (manufactured by Mitsui Chemicals, Inc., Bariastar (registered trademark) B-1000, weight ratio of core: shell=1:1.5, solids content: 20%) and 75 parts of an ionomeric urethane-based resin latex (manufactured by Dainippon Ink & Chemicals, Inc., Hydran (registered trademark) AP-30F, solids content: 20%) as binders, and 0.5 parts of spherical resin particles having a mean volume particle diameter of 8 μm (measured according to the Coulter counter method) (manufactured by Ganz Chemical Co., Ltd., Ganz Pearl (registered trademark) GM-0801, polymethylmethacrylate) was stirred to give a backside layer coating composition.

Preparation of Dispersion of Leuco Dye-Containing Composite Particles (Dispersion A)

Leuco dyes (12 parts of 3-di(n-butyl)amino-6-methyl-7-anilinofluoran, 5 parts of 3-diethylamino-6,8-dimethylfluoran, and 3 parts of 3,3-bis(4-diethylamino-2-ethoxyphenyl)-4-azaphthalide) and a UV-absorber (5 parts of 2-hydroxy-4-octyloxybenzophenone) were dissolved with heating (150° C.) in a mixed solvent of 11 parts of dicyclohexylmethane-4,4'-diisocyanate (manufactured by Sumitomo Bayer Urethane Co., Ltd., Desmodule W) and 11 parts of m-tetramethylxylylene diisocyanate (manufactured by Mitsui Takeda Chemicals, Inc., TMXDI). This solution was slowly added to 100 parts of an aqueous solution containing 8.8 parts of polyvinyl alcohol (manufactured by Kuraray Co., Ltd., Kuraray Poval (registered trademark) PVA-217EE) and as a surfactant 0.5 parts of an ethyleneoxide adduct of acetylene glycol (manufactured by Nissin Chemical Industry Co., Ltd., Olfine E1010), and the resulting mixture was emulsified and dispersed in a homogenizer at 10000 rpm.

To this emulsion/dispersion was added 30 parts of water and an aqueous solution prepared by dissolving 2.5 parts of a polyamine compound (manufactured by Shell International Petroleum Co., Epicure T) in 22.5 parts of water to homogenize the emulsion/dispersion. The emulsion/dispersion was heated to 75° C. to carry out polymerization reaction for 7 hours, thereby giving a black-color-forming composite particle dispersion having a mean volume particle diameter of 0.8 μm (measured according to the laser diffraction method).

The solids content of the black-color-forming composite particles dispersion was adjusted with water to 20%.

Preparation of Dispersion B

A composition containing 25 parts of 4,4'-dihydroxydiphenylsulfone, 15 parts of 3,3'-diallyl-4,4'-dihydroxydiphenylsulfone, 40 parts of a 25% aqueous solution of polyvinyl alcohol (manufactured by Kuraray Co., Ltd., Kuraray Poval PVA-203), 5 parts of a 2% emulsion of a natural oil and fat-based antifoaming agent, 10 parts of a 5% aqueous solution of sodium dioctylsulfosuccinate, and 50 parts of water was pulverized by a horizontal sand mill (manufactured by Aimex Co., Ltd., Ultra Visco Mill UVX-2) to a mean volume particle diameter of 0.3 μm (measured according to the laser diffraction method), thereby giving Dispersion B.

Preparation of Heat-Sensitive Recording Layer Coating Composition

A composition containing 150 parts of Dispersion A, 115 parts of Dispersion B, 20 parts of a 7% aqueous solution of polyvinyl alcohol (Kuraray Co., Ltd., Kuraray Poval (registered trademark) PVA-235), 30 parts of a styrene-butadiene-based latex (manufactured by Nippon A&L Inc., solids content: 48%, Smartex (registered trademark) PA9281), 50 parts of an ionomeric urethane-based resin latex (manufactured by Dainippon Ink & Chemicals, Inc., Hydran (registered trademark) AP-30F, solids content: 20%), 8 parts of a 5% aqueous solution of adipic dihydrazide, and 30 parts of water was stirred to give a heat-sensitive recording layer coating composition.

Preparation of Protective Layer Coating Composition

A composition containing 100 parts of an ionomeric urethane-based resin latex (manufactured by Dainippon Ink & Chemicals Inc., Hydran (registered trademark) AP-30F, solids content: 20%), 500 parts of an 8% aqueous solution of an acetoacetyl-modified polyvinyl alcohol (manufactured by Nippon Synthetic Chemical Industry Co., Ltd., Gohsefimer (registered trademark) OKS-3431, degree of polymerization: about 2300, degree of saponification: about 98 mol %, degree of acetoacetyl modification: 4 mol %), 5 parts of a 25% aqueous solution of a polyamidoamine-epichlorohydrin, 50 parts of a 60% slurry of kaolin having a mean volume particle diameter of 0.8 μm (manufactured by Engelhard Corporation, UW-90), 26 parts of stearamide (manufactured by Chukyo Yushi Co., Ltd., Hymicron L271, solids content: 25%, mean volume particle diameter: 0.4 μm), 4 parts of potassium stearyl phosphate (manufactured by Matsumoto Yushi Seiyaku, Woopol (registered trademark) 1800, solids content: 35%), 15 parts of a 10% aqueous solution of an ethylene oxide adduct of perfluoroalkyl amide (manufactured by Seimi Chemical Co., Ltd., Surflon (registered trademark) S-145), and 300 parts of water was stirred to give a protective layer coating composition.

Preparation of Heat-Sensitive Recording Material

The backside layer coating composition was applied, in an amount of 4 g/m$^2$ on dry weight basis, to one side (backside) of a blue transparent polyethylene terephthalate film (trade name: Melinex (registered trademark) 914, manufactured by Teijin DuPont Films Japan Limited, thickness: 175 μm, haze value: 3%) and dried to form a backside layer. The heat-sensitive recording layer coating composition and the protective layer coating composition were successively applied to the other side (front side) of the film in amounts of 23 g/m$^2$ and 4 g/m$^2$, respectively, on dry weight basis, and dried to form a heat-sensitive recording layer and a protective layer, thereby giving a heat-sensitive recording material.

EXAMPLE 2

A heat-sensitive recording material was produced in the same manner as in Example 1 except that, in the preparation of the backside layer coating composition, spherical resin particles having a mean volume particle diameter of 8 μm (manufactured by Ganz Chemical Co., Ltd., Ganz Pearl (registered trademark) GM-0801, polymethylmethacrylate) were used in an amount of 3.5 parts instead of 0.5 parts.

EXAMPLE 3

A heat-sensitive recording material was produced in the same manner as in Example 1 except that, in the preparation of the backside layer coating composition, spherical resin particles having a mean volume particle diameter of 8 μm (manufactured by Ganz Chemical Co., Ltd., Ganz Pearl (registered trademark) GM-0801, polymethylmethacrylate) were used in an amount of 0.3 parts instead of 0.5 parts.

EXAMPLE 4

A heat-sensitive recording material was produced in the same manner as in Example 1 except that, in the preparation of the backside layer coating composition, spherical resin particles having a mean volume particle diameter of 8 μm (manufactured by Ganz Chemical Co., Ltd., Ganz Pearl (registered trademark) GM-0801, polymethylmethacrylate) were used in an amount of 5.0 parts instead of 0.5 parts.

EXAMPLE 5

A heat-sensitive recording material was produced in the same manner as in Example 1 except that, in the preparation of the heat-sensitive recording material, the backside layer coating composition was applied in an amount such that the coating composition after being dried had an amount of 0.6 g/m$^2$ instead of 4 g/m$^2$.

EXAMPLE 6

A heat-sensitive recording material was produced in the same manner as in Example 1 except that, in the preparation of the heat-sensitive recording material, the backside layer coating composition was applied in an amount such that the coating composition after being dried had an amount of 8 g/m$^2$ instead of 4 g/m$^2$.

EXAMPLE 7

A heat-sensitive recording material was produced in the same manner as in Example 1 except that, in the preparation of the heat-sensitive recording material, the backside layer coating composition was applied in an amount such that the coating composition after being dried had an amount of 0.3 g/m$^2$ instead of 4 g/m$^2$.

EXAMPLE 8

A heat-sensitive recording material was produced in the same manner as in Example 1 except that, in the preparation of the heat-sensitive recording material, the backside layer coating composition was applied in an amount such that the coating composition after being dried had an amount of 12 g/m$^2$ instead of 4 g/m$^2$.

EXAMPLE 9

A heat-sensitive recording material was produced in the same manner as in Example 1 except that, in the preparation of the backside layer coating composition, 185 parts of an acrylic acid-acrylic acid ester copolymer latex having a glass transition temperature of 33° C. (manufactured by Saiden Chemical Industry, Saibinol (registered trademark) X-500-280E, solids content 46%) and 240 parts of water were used in place of 425 parts of the core-shell latex (manufactured by Mitsui Chemicals, Inc., Barriastar (registered trademark) B-1000, solids content: 20%).

EXAMPLE 10

A heat-sensitive recording material was produced in the same manner as in Example 1 except that, in the preparation of the backside layer coating composition, 275 parts of an acrylic acid-acrylic acid ester copolymer latex having a glass transition temperature of 88° C. (manufactured by Saiden Chemical Industry, Saibinol (registered trademark) EK-106, solids content 31%) and 150 parts of water were used in place of 425 parts of the core-shell latex (manufactured by Mitsui Chemicals, Inc., Barriastar (registered trademark) B-1000, solids content: 20%).

EXAMPLE 11

A heat-sensitive recording material was produced in the same manner as in Example 1 except that, in the preparation of the backside layer coating composition, 220 parts of an acrylic acid-acrylic acid ester copolymer latex having a glass transition temperature of 10° C. (manufactured by Saiden Chemical Industry, Saibinol (registered trademark) EK-32, solids content 39%) and 205 parts of water were used in place of 425 mass parts of the core-shell latex (manufactured by Mitsui Chemicals, Inc., Bariastar (registered trademark) B-1000, solids content: 20%).

EXAMPLE 12

A heat-sensitive recording material was produced in the same manner as in Example 1 except that, in the preparation of the backside layer coating composition, 75 parts of a core-shell latex (manufactured by Mitsui Chemicals, Inc., Bariastar (registered trademark) B-1000, solids content: 20%) was used in place of 75 parts of the urethane-based resin latex (manufactured by Dainippon Ink & Chemicals, Inc., Hydran (registered trademark) AP-30F, solids content: 20%).

EXAMPLE 13

A heat-sensitive recording material was produced in the same manner as in Example 1 except that, in the preparation of the backside layer coating composition, 0.5 parts of spherical resin particles having a mean volume particle diameter of 4 μm (manufactured by Ganz Chemical Co., Ltd., Ganz Pearl (registered trademark), polymethylmethacrylate) was used in place of 0.5 parts of the spherical resin particles having a mean volume particle diameter of 8 μm (manufactured by Ganz Chemical Co., Ltd., Ganz Pearl (registered trademark) GM-0801, polymethylmethacrylate).

EXAMPLE 14

A heat-sensitive recording material was produced in the same manner as in Example 1 except that, in the preparation of the backside layer coating composition, 0.5 parts of spherical resin particles having a mean volume particle diameter of 10 μm (manufactured by Ganz Chemical Co., Ltd., Ganz Pearl (registered trademark), polymethylmethacrylate) was used in place of 0.5 parts of the spherical resin particles having a mean volume particle diameter of 8 μm (manufactured by Ganz Chemical Co., Ltd., Ganz Pearl (registered trademark) GM-0801, polymethylmethacrylate).

EXAMPLE 15

A heat-sensitive recording material was produced in the same manner as in Example 1 except that, in the preparation of the protective layer coating composition, 250 parts of an 8% aqueous solution of acetoacetyl-modified polyvinyl alcohol (manufactured by Nippon Synthetic Chemical Industry Co., Ltd., Gohsefimer (registered trademark) OKS-3431, degree of polymerization: about 2300, degree of saponification: about 98 mol %) was used in place of 100 parts of the ionomeric urethane-based resin latex (manufactured by Dainippon Ink & Chemicals Inc., Hydran (registered trademark) AP-30F, solids content: 20%).

EXAMPLE 16

A heat-sensitive recording material was produced in the same manner as in Example 1 except that, in the preparation of the protective layer coating composition, 500 parts of an 8% aqueous solution of acetoacetyl-modified polyvinyl alcohol (manufactured by Nippon Synthetic Chemical Industry Co., Ltd., Gohsefimer (registered trademark) Z-200, degree of polymerization: about 1000, degree of saponification: about 98 mol %) was used in place of 500 parts of the 8% aqueous solution of acetoacetyl nodified polyvinyl alcohol (manufactured by Nippon Synthetic Chemical Industry Co., Ltd., Gohsefimer (registered trademark) OKS-3431, degree of polymerization: about 2300, degree of saponification: about 98 mol %).

EXAMPLE 17

A heat-sensitive recording material was produced in the same manner as in Example 1 except that, in the preparation of the protective layer coating composition, 79 parts of a 10% aqueous solution of an ethyleneoxide adduct of perfluoroalkyl amide (manufactured by Seimi Chemical Co., Ltd., Surflon (registered trademark) S-145) was used in place of 26 parts of stearamide (manufactured by Chukyo Yushi Co., Ltd., Hymicron L271, solids content: 25%) and 4 parts of potassium stearyl phosphate (manufactured by Matsumoto Yushi Seiyaku, Woopol (registered trademark) 1800, solids content: 35%).

EXAMPLE 18

A heat-sensitive recording material was produced in the same manner as in Example 1 except that, in the preparation of the protective layer coating composition, 16 parts of a polyethylene wax (manufactured by San Nopco Limited, Nopcote (registered trademark) PEM-17, solids content: 40%) was used in place of 26 parts of stearamide (manufactured by Chukyo Yushi Co., Ltd., Hymicron L271, solids content: 25%).

EXAMPLE 19

A heat-sensitive recording material was produced in the same manner as in Example 1 except that, in the preparation of the heat-sensitive recording layer coating composition, 20 parts of a styrene-butadiene-based latex (manufactured by Nippon A&L Inc., solids content: 48%, Smartex (registered trademark) PA9281) was used in place of 50 parts of ionomeric urethane-based resin latex (manufactured by Dainippon Ink & Chemicals, Inc., Hydran (registered trademark) AP-30F, solids content: 20%).

EXAMPLE 20

A heat-sensitive recording material was produced in the same manner as in Example 1 except that, in the preparation of the heat-sensitive recording layer coating composition, 75 parts of an ionomeric urethane-based resin latex (manufactured by Dainippon Ink & Chemicals, Inc., Hydran (registered trademark) AP-30F, solids content: 20%) was used in place of 30 parts of the styrene-butadiene-based latex (manufactured by Nippon A&L Inc., solids content: 48%, Smartex (registered trademark) PA9281).

EXAMPLE 21

A heat-sensitive recording material was produced in the same manner as in Example 1 except that, in the preparation of the heat-sensitive recording layer coating composition, 61 parts of a latex having a solids content of 41% and prepared by polymerizing styrene monomer and butadiene monomer in an aqueous medium containing a polyurethane ionomer (Patelacol (registered trademark) 2090, manufactured by Dainippon Ink & Chemicals, Inc.) was used in place of 30 parts of the styrene-butadiene-based latex (manufactured by Nippon A&L Inc., solids content: 48%, Smartex (registered trademark) PA9281) and 50 parts of the ionomeric urethane-based resin latex (manufactured by Dainippon Ink & Chemicals, Inc., Hydran (registered trademark) AP-30F, solids content: 20%).

COMPARATIVE EXAMPLE 1

A heat-sensitive recording material was produced in the same manner as in Example 1 except that, in the preparation of the backside layer coating composition, spherical resin particles having a mean volume particle diameter of 8 μm (manufactured by Ganz Chemical Co., Ltd., Ganz Pearl (registered trademark) GM-0801, polymethylmethacrylate) were used in an amount of 0.1 parts instead of 0.5 parts.

COMPARATIVE EXAMPLE 2

A heat-sensitive recording material was produced in the same manner as in Example 1 except that, in the preparation of the backside layer coating composition, spherical resin particles having a mean volume particle diameter of 8 μm (manufactured by Ganz Chemical Co., Ltd., Ganz Pearl (registered trademark) GM-0801, polymethylmethacrylate) were used in an amount of 8.0 parts instead of 0.5 parts.

COMPARATIVE EXAMPLE 3

A heat-sensitive recording material was produced in the same manner as in Example 1 except that, in the preparation of the backside layer coating composition, 0.5 parts of spherical resin particles having a mean volume particle diameter of 20 μm (manufactured by Ganz Chemical Co., Ltd., Ganz Pearl (registered trademark), polymethylmethacrylate) was used in place of 0.5 parts of the spherical resin particles having a mean volume particle diameter of 8 μm (manufactured by Ganz Chemical Co., Ltd., Ganz Pearl (registered trademark) GM-0801, polymethylmethacrylate).

COMPARATIVE EXAMPLE 4

A heat-sensitive recording material was produced in the same manner as in Example 1 except that, in the preparation of the backside layer coating composition, 0.5 parts of spherical resin particles having a mean volume particle diameter of 1 μm was used in place of 0.5 parts of spherical resin particles having a mean volume particle diameter of 8 μm (manufactured by Ganz Chemical Co., Ltd., Ganz Pearl (registered trademark) GM-0801, polymethylmethacrylate).

[Evaluation of Heat-Sensitive Recording Materials]

The heat-sensitive recording materials obtained above were evaluated as follows. Table 1 shows the results.

Blocking Resistance

Five pieces (10 cm×10 cm each) of a heat-sensitive recording material were placed one on top of another such that the front side of each piece faced upward. A 200 g copper plate (10 cm×10 cm) was placed on the uppermost piece, and the heat-sensitive recording materials were left to stand at 40° C. at 90% RH for 7 days. The extent of the resistance to blocking between the backside of the second piece from the top and the front side of the third piece from the top was visually examined.

◎: No trace of blocking observable on the front side of the heat-sensitive recording material ○: Trace of blocking minimally observable on the front side of the heat-sensitive recording material Δ: Traces of blocking somewhat observable on the front side of the heat-sensitive recording material ×: Many traces of blocking observable on the front side of the heat-sensitive recording material Multi-Feeding Resistance Forty A4-sized pieces of heat-sensitive recording material were left to stand at 23° C. and 50% RH for 2 hours. These pieces were then subjected to recording by means of a thermal printer (trade name: NP1660M, manufactured by CODONICS) while examining the extent of the multi-feeding resistance thereof.

☆: No multi-feeding

◎: Multi-feeding once

○: Multi-feeding two or three times

×: Multi-feeding at least four times

Curl Resistance

An A4-sized piece of heat-sensitive recording material was horizontally placed with the inwardly curled surface facing upward. The height of its 4 corners was measured, and the average value thereof (mm) was referred to as curl value; the smaller the curl value, the better the resistance to curling. Note that curling created in the direction of the recording surface is indicated by "+", and curling created in the direction of the backside is indicated by "−". The measurement of curl values prior to recording was carried out with respect to the heat-sensitive recording materials that had been left to stand at 23° C. and 15% RH for 2 hours, and also with respect to the heat-sensitive recording material that had been left to stand at 23° C. and 50% RH for 2 hours. The curl value after recording was measured as follows: heat-sensitive recording materials that had been left to stand at 23° C. and 50% RH for 2 hours were subjected to recording by means of a thermal printer (trade name: NP1660M, manufactured by Codonics, Inc.), and immediately thereafter left to stand at 23° C. and 15% RH for 30 minutes or at 23° C. and 50% RH for 30 minutes, and the curl value of each heat-sensitive recording material was measured.

Coefficient of Friction

The coefficient of static friction between the front side and the backside of a heat-sensitive recording material was measured according to ASTM D4521-96 (horizontal plane method)

Thickness of Backside Layer

The thickness (μm) of the backside layer of a heat-sensitive recording material was calculated from an electron micrograph of the cross section of the recording material.

Haze Value

The haze value of a heat-sensitive recording material was measured according to JIS K 7136 by a haze meter (TC-H IV, manufactured by Tokyo Denshoku).

Resistance to Residual Substance Accumulation on Thermal Head

Recording was conducted using a thermal printer (UP-930, manufactured by Sony Corporation) over a length of 5 m. Residual substance accumulation on the thermal head was visually examined.

◎: No observable residual substance accumulation on the thermal head

○: Residual substance accumulation on the thermal head somewhat observable

×: Considerable residual substance accumulation on the thermal head observable

Resistance to Surface Roughing and Glossiness of Recorded Portions

The glossiness of unrecorded portions and recorded portions produced by a thermal head at an energy of 30 mJ/mm$^2$ (low energy) or 80 mJ/mm$^2$ (high energy) (resistance: 520 Ω, 8 dots/mm, 0.015 mm$^2$/dot, applied pulse width: 2 m sec, applied pulse cycle: 5 m sec, line pressure: 0.02 MPa/cm) was measured using a gloss meter (product name: GM-26D, manufactured by Murakami Color Research Laboratory) with an incidence angle of 75°.

Recorded portions produced at high energy were visually inspected for resistance to surface roughing and evaluated as follows.

◎: Surface of recorded portion was scarcely roughened.

○: Surface of recorded portion was slightly roughened.

×: Surface of recorded portion was severely roughened.

Blurring Resistance

The above-mentioned recorded portion produced at high energy was visually checked for blurring and evaluated as follows.

◎: No blurring at the edges of recorded portions

×: Blurring at the edges of recorded portions

TABLE 1

| | Backside layer | | | | Curl Resistance (mm) | | | | | |
|---|---|---|---|---|---|---|---|---|---|---|
| | Resin particles mean diameter (μm) | Resin particles content (%) | Thickness (μm) | Tg of main binder (° C.) | Before recording (23° C.) 50% RH | Before recording (23° C.) 15% RH | After recording (23° C.) 50% RH | After recording (23° C.) 15% RH | Coefficient of static friction | Blocking resistance |
| Ex. 1 | 8 | 0.5 | 4 | 218 | +1 | +4 | +4 | −4 | 0.20 | ◎ |
| Ex. 2 | 8 | 3.4 | 4 | 218 | +1 | +4 | +4 | −4 | 0.18 | ◎ |
| Ex. 3 | 8 | 0.3 | 4 | 218 | +1 | +4 | +4 | −4 | 0.22 | ◎ |
| Ex. 4 | 8 | 4.8 | 4 | 218 | +1 | +4 | +4 | −4 | 0.18 | ◎ |
| Ex. 5 | 8 | 0.5 | 0.6 | 218 | +2 | +5 | +5 | 0 | 0.20 | ◎ |
| Ex. 6 | 8 | 0.5 | 8 | 218 | −1 | +1 | +2 | −3 | 0.20 | ◎ |
| Ex. 7 | 8 | 0.5 | 0.3 | 218 | +4 | +6 | +7 | +1 | 0.25 | ◎ |
| Ex. 8 | 8 | 0.5 | 12 | 218 | −2 | +2 | +1 | −5 | 0.23 | ○ |
| Ex. 9 | 8 | 0.5 | 4 | 33 | +2 | +5 | +6 | +2 | 0.25 | ◎ |
| Ex. 10 | 8 | 0.5 | 4 | 88 | +1 | +5 | +5 | −3 | 0.22 | ◎ |
| Ex. 11 | 8 | 0.5 | 4 | 10 | 0 | +5 | +7 | +5 | 0.28 | ○ |
| Ex. 12 | 8 | 0.5 | 4 | 218 | +1 | +4 | +4 | −3 | 0.20 | ○ |
| Ex. 13 | 4 | 0.5 | 4 | 218 | +1 | +4 | +4 | −4 | 0.23 | ◎ |
| Ex. 14 | 10 | 0.5 | 4 | 218 | +1 | +4 | +4 | −4 | 0.18 | ◎ |
| Ex. 15 | 8 | 0.5 | 4 | 218 | +1 | +4 | +4 | −4 | 0.20 | ◎ |
| Ex. 16 | 8 | 0.5 | 4 | 218 | +1 | +4 | +4 | −4 | 0.20 | ◎ |
| Ex. 17 | 8 | 0.5 | 4 | 218 | +1 | +4 | +4 | −4 | 0.20 | ◎ |
| Ex. 18 | 8 | 0.5 | 4 | 218 | +1 | +4 | +4 | −4 | 0.20 | ◎ |
| Ex. 19 | 8 | 0.5 | 4 | 218 | +1 | +4 | +4 | −4 | 0.20 | ◎ |
| Ex. 20 | 8 | 0.5 | 4 | 218 | +1 | +4 | +4 | −4 | 0.20 | ◎ |
| Ex. 21 | 8 | 0.5 | 4 | 218 | +1 | +4 | +4 | −4 | 0.20 | ◎ |
| Comp. Ex. 1 | 8 | 0.1 | 4 | 218 | +1 | +4 | +4 | −4 | 0.31 | ○ |
| Comp. Ex. 2 | 8 | 7.4 | 4 | 218 | +1 | +4 | +4 | −4 | 0.26 | ◎ |
| Comp. Ex. 3 | 20 | 0.5 | 4 | 218 | +1 | +4 | +4 | −4 | 0.25 | Δ |
| Comp. Ex. 4 | 1 | 0.5 | 4 | 218 | +1 | +4 | +4 | −4 | 0.32 | X |

TABLE 1-continued

| | Multi-feeding resist-ance | Haze value | Resistance to adhesion of residual substance to head | Resistance to surface roughing of recorded portion | Glossiness (%) Unrecorded portion | At low energy | At high energy | Blurring resist-ance |
|---|---|---|---|---|---|---|---|---|
| Ex. 1 | ☆ | 34% | ◎ | ◎ | 91 | 92 | 94 | ○ |
| Ex. 2 | ☆ | 38% | ◎ | ◎ | 91 | 92 | 94 | ○ |
| Ex. 3 | ☆ | 34% | ◎ | ◎ | 91 | 92 | 94 | ○ |
| Ex. 4 | ☆ | 40% | ◎ | ◎ | 91 | 92 | 94 | ○ |
| Ex. 5 | ☆ | 32% | ◎ | ◎ | 91 | 92 | 94 | ○ |
| Ex. 6 | ☆ | 38% | ◎ | ◎ | 91 | 92 | 94 | ○ |
| Ex. 7 | ○ | 32% | ◎ | ◎ | 91 | 92 | 94 | ○ |
| Ex. 8 | ◎ | 41% | ◎ | ◎ | 91 | 92 | 94 | ○ |
| Ex. 9 | ☆ | 33% | ◎ | ◎ | 91 | 92 | 94 | ○ |
| Ex. 10 | ☆ | 34% | ◎ | ◎ | 91 | 92 | 94 | ○ |
| Ex. 11 | ○ | 33% | ◎ | ◎ | 91 | 92 | 94 | ○ |
| Ex. 12 | ☆ | 34% | ◎ | ◎ | 91 | 92 | 94 | ○ |
| Ex. 13 | ☆ | 35% | ◎ | ◎ | 91 | 92 | 94 | ○ |
| Ex. 14 | ☆ | 34% | ◎ | ◎ | 91 | 92 | 94 | ○ |
| Ex. 15 | ☆ | 32% | ◎ | ◎ | 93 | 93 | 91 | ○ |
| Ex. 16 | ☆ | 34% | ◎ | X | 90 | 91 | 80 | ○ |
| Ex. 17 | ☆ | 31% | X | ○ | 94 | 94 | 93 | ○ |
| Ex. 18 | ☆ | 33% | ○ | ◎ | 92 | 91 | 93 | ○ |
| Ex. 19 | ☆ | 32% | ◎ | ◎ | 91 | 92 | 94 | X |
| Ex. 20 | ☆ | 33% | ◎ | ◎ | 91 | 92 | 94 | X |
| Ex. 21 | ☆ | 32% | ◎ | ◎ | 91 | 92 | 94 | ○ |
| Comp. Ex. 1 | X | 31% | ◎ | ◎ | 91 | 92 | 94 | ○ |
| Comp. Ex. 2 | Δ | 52% | ◎ | ◎ | 91 | 92 | 94 | ○ |
| Comp. Ex. 3 | Δ | 32% | ◎ | ◎ | 91 | 92 | 94 | ○ |
| Comp. Ex. 4 | X | 31% | ◎ | ◎ | 91 | 92 | 94 | ○ |

INDUSTRIAL APPLICABILITY

As shown in Table 1, the heat-sensitive recording material of the invention has the effect of preventing the blocking that is caused by adhesion of the front side and backside of the heat-sensitive recording material even when exposed to conditions of 40° C. and 90% RH.

The invention claimed is:

1. A heat-sensitive recording material comprising:

(a) a transparent film;

(b) a heat-sensitive recording layer formed on one side of the transparent film, and containing an electron-donating compound, an electron-accepting compound, and a binder, the binder being a urethane-based resin and a styrene-butadiene-based resin;

(c) a protective layer formed on the heat-sensitive recording layer, and containing an aqueous resin as a main ingredient, the aqueous resin being an acetoacetyl-modified polyvinyl alcohol having a polymerization degree of 1500 to 3000 and a saponification degree of at least 95 mol %, the protective layer further containing a fluorine-containing surfactant and at least one compound selected from the group consisting of alkyl phosphate salts, waxes and higher fatty acid amides; and (d) a backside layer formed on the other side of the transparent film, and containing a pigment and a binder, the heat-sensitive recording material containing, as the pigment, in the backside layer spherical resin particles having a mean volume particle diameter of 2 to 15 μm in an amount of 0.2 to 5.0 mass % of the backside layer, the average thickness of the backside layer being 0.5 to 10 μm and being less than or equal to the mean volume particle diameter of the spherical resin particles contained in the backside layer, and the binder in the backside layer being a (meth)acrylamide-based resin binder having a glass transition temperature of 180 to 250° C. and an ionomeric urethane-based resin, the ionomeric urethane-based resin being contained in an amount of 3 to 30 mass % of all the binders.

2. A heat-sensitive recording material according to claim 1, wherein the average thickness of the backside layer is 0.5 to 10 μm and is less than the mean volume particle diameter of the spherical resin particles contained in the backside layer.

3. A heat-sensitive recording material according to claim 1, wherein the (meth)acrylamide-based resin binder in the backside layer is a core-shell-structured latex.

4. A heat-sensitive recording material according to claim 1, wherein the (meth)acrylamide-based resin binder has a glass transition temperature of 200 to 230° C.

5. A heat-sensitive recording material according to claim 1, wherein the ionomeric urethane-based resin is contained in an amount of 5 to 20 mass % of all the binders.

6. A heat-sensitive recording material according to claim 1, wherein the protective layer further contains an ionomeric urethane-based resin as an aqueous resin.

7. A heat-sensitive recording material according to claim 6, wherein the ionomeric urethane-based resin is present in an amount of 10 to 60 mass % relative to the acetoacetyl-modified polyvinyl alcohol.

8. A heat-sensitive recording material according to claim 1, wherein the total amount of the fluorine-containing surfactant and said at least one compound selected from the group consisting of alkyl phosphate salts, waxes and higher fatty acid amides in the protective layer is 0.5 to 15 mass % of the protective layer.

9. A heat-sensitive recording material according to claim 1, wherein said at least one compound selected from the group consisting of alkyl phosphate salts, waxes and higher fatty acid amides is present in an amount of 50 to 800 mass % relative to the fluorine-containing surfactant in the protective layer.

10. A heat-sensitive recording material according to claim 1, wherein the protective layer contains an alkyl phosphate salt, a fluorine-containing surfactant, and a compound selected from the group consisting of waxes and higher fatty acid amides.

11. A heat-sensitive recording material according to claim 1, wherein the protective layer contains an alkyl phosphate salt, a higher fatty acid amide and a fluorine-containing surfactant.

12. A heat-sensitive recording material according to claim 1, wherein the binder in the heat-sensitive recording layer is an ionomeric urethane-based resin and a styrene-butadiene-based resin.

13. A heat-sensitive recording material according to claim 1, wherein the styrene-butadiene-based resin is present in an amount of 100 to 300 mass parts per 100 mass parts of the ionomeric urethane-based resin.

14. A heat-sensitive recording material according to claim 1, wherein the electron-donating compound in the heat-sensitive recording layer is a leuco dye, and the leuco dye is microencapsulated in a resin film or is in the form of a resin composite particle containing the leuco dye.

15. A heat-sensitive recording material according to claim 1, wherein the heat-sensitive recording layer has a thickness of 15 to 30 μm.

16. A heat-sensitive recording material according to claim 1, wherein the transparent film is a polyethylene terephthalate film having a thickness of 40 to 250 μm.

17. A heat-sensitive recording material according to claim 1 having a haze value of 10 to 50%.

* * * * *